US010588401B1

(12) United States Patent
Lu

(10) Patent No.: US 10,588,401 B1
(45) Date of Patent: Mar. 17, 2020

(54) HEIGHT-ADJUSTABLE MULTIFUNCTIONAL TABLE

(71) Applicant: Dong Guan Song Wei Electric Technology Co., Ltd., Dongguan, Guangdong (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 16/226,670

(22) Filed: Dec. 20, 2018

(51) Int. Cl.
*A47B 9/04* (2006.01)
*A47B 9/20* (2006.01)

(52) U.S. Cl.
CPC *A47B 9/04* (2013.01); *A47B 9/20* (2013.01); *A47B 2009/046* (2013.01); *A47B 2200/0056* (2013.01)

(58) Field of Classification Search
CPC .. A47B 9/04; A47B 9/20; A47B 21/00; A47B 2200/0056; A47B 2200/0066
USPC ..... 108/23, 50.01, 50.02, 147
See application file for complete search history.

(56) References Cited

U.S. PATENT DOCUMENTS 4,515,086 A * 5/1985 Kwiecinski ..... A47B 21/0314 108/104
5,174,224 A * 12/1992 Nagy ..... A47B 21/00 108/185
5,555,819 A * 9/1996 Lochridge ..... A47B 21/00 108/1
6,012,788 A * 1/2000 Marschand ..... A47B 21/00 108/25
6,267,064 B1 * 7/2001 Ostertag ..... A47B 13/021 108/108
6,286,440 B1 * 9/2001 Jyringi ..... A47B 21/00 108/50.01
6,446,564 B1 * 9/2002 Anderson ..... A47B 21/007 108/71
6,553,919 B1 * 4/2003 Nevin ..... A47B 21/0073 108/25
6,595,144 B1 * 7/2003 Doyle ..... A47B 9/00 108/147
7,920,125 B2 * 4/2011 Imamura ..... G06F 1/1616 108/23
9,723,920 B1 * 8/2017 Wu ..... A47B 21/02
10,092,090 B1 * 10/2018 Chen ..... A47B 13/081
2003/0033963 A1 * 2/2003 Doyle ..... A47B 9/04 108/147.19
2004/0150300 A1 * 8/2004 Wyatt ..... A47B 21/00 312/223.3
2006/0267952 A1 * 11/2006 Alcorn ..... A47B 21/007 345/173

(Continued)

*Primary Examiner* — Jose V Chen
(74) *Attorney, Agent, or Firm* — Leong C. Lei

(57) ABSTRACT

A height-adjustable multifunctional table includes a base, at least two independent and height-adjustable table legs, a retaining frame, a tabletop, a power adapter, a controller, and a hand controller. Through the wireless connection between the hand controller and the controller, the controller is used to control a driving mechanism, and the driving mechanism drives a movable inner tube to move up and down so as to adjust the height of a tabletop. The user only needs to control the hand controller to adjust the height of the tabletop. The height adjustment is easy and more convenient and saves time and labour.

9 Claims, 11 Drawing Sheets

(56) References Cited

U.S. PATENT DOCUMENTS

2006/0279143 A1* 12/2006 Platz ..... A47B 9/04 310/51
2008/0143218 A1* 6/2008 Alayev ..... A47B 21/0073 312/1
2009/0284655 A1* 11/2009 Lukes ..... A47B 21/007 348/552
2011/0061570 A1* 3/2011 Klinke ..... A47B 9/20 108/20
2011/0075337 A1* 3/2011 Riley ..... A47B 21/0073 361/679.2
2012/0126072 A1* 5/2012 Pettersson ..... A47B 9/04 248/157
2012/0248910 A1* 10/2012 Randlov ..... A47B 9/04 310/83
2012/0250239 A1* 10/2012 Cao ..... A47B 21/0073 361/679.21
2014/0103174 A1* 4/2014 Koder ..... A47B 9/04 248/188.5
2014/0299025 A1* 10/2014 Moita Gorgulho Soares Branco ..... A47B 21/007 108/50.02
2014/0336822 A1* 11/2014 Kristensen ..... G05B 15/02 700/275
2015/0007756 A1* 1/2015 Kollreider ..... A47B 9/04 108/21
2015/0293641 A1* 10/2015 Chartier ..... A47B 21/007 345/173
2016/0170402 A1* 6/2016 Lindstrom ..... A47B 9/00 700/275
2016/0260019 A1* 9/2016 Riquelme Ruiz .... A47B 21/007
2017/0251806 A1* 9/2017 Newman ..... A47B 21/02
2017/0303679 A1* 10/2017 Tseng ..... A47B 9/04
2018/0000240 A1* 1/2018 Yamamoto ..... A47B 9/20
2018/0014634 A1* 1/2018 Pizzinato ..... A47B 13/003
2018/0172062 A1* 6/2018 Hu ..... A47B 9/04
2018/0184799 A1* 7/2018 Lin ..... A47B 17/02
2018/0368569 A1* 12/2018 Laing ..... A47B 9/00
2019/0025860 A1* 1/2019 Kollreider ..... A47B 9/04
2019/0029413 A1* 1/2019 Patton ..... A47B 9/20
2019/0059573 A1* 2/2019 Tseng ..... A47B 9/04
2019/0208902 A1* 7/2019 Cao ..... A47B 13/088
2019/0223586 A1* 7/2019 Hansen ..... A47B 9/00
2019/0261778 A1* 8/2019 Lukas ..... A47C 20/041

* cited by examiner

HEIGHT-ADJUSTABLE MULTIFUNCTIONAL TABLE

BACKGROUND OF THE INVENTION

1. Field of the Invention

The present invention relates to a table, and more particularly to a height-adjustable multifunctional table.

2. Description of the Prior Art

Tables are widely used in our daily life for eating, working, etc. In general, a table structure mainly includes table legs and a tabletop disposed on the table legs. Most of the tables are placed directly on the ground. The height of the table cannot be adjusted according to the needs of the user. Although there are some tables that can be adjusted in height on the market. Most of tables are adjusted manually. The height adjustment is inconvenient, time-consuming and laborious. The tables have a single function, which cannot meet the needs of use. Therefore, it is necessary to improve the conventional table.

SUMMARY OF THE INVENTION

In view of the drawbacks of the prior art, the primary object of the present invention is to provide a height-adjustable multifunctional table which can effectively solve the problem that the conventional table is inconvenient for height adjustment and has a single function.

In order to achieve the above object, the present invention adopts the following technical solutions:

A height-adjustable multifunctional table comprises a base, at least two independent and height-adjustable table legs, a retaining frame, a tabletop, a power adapter, a controller, and a hand controller.

The table legs are spaced apart and arranged vertically. Each of the table legs includes an immovable outer tube and a movable inner tube. A lower end of the immovable outer tube is fixed to the base. The movable inner tube is movably disposed in the immovable outer tube. An upper end of the movable inner tube extends out of the immovable outer tube. Each of the table legs is provided with a driving mechanism for driving the movable inner tube to move up and down.

The retaining frame is fixedly connected to the upper end of the movable inner tube of each of the table legs. The tabletop is disposed on top of the retaining frame and fixedly connected to the retaining frame.

The power adapter and the controller are fixedly connected to the tabletop. The controller is connected to the power adapter. The driving mechanism is connected to the controller. The hand controller is wirelessly connected to the controller.

Compared with the prior art, the present invention has obvious advantages and beneficial effects. Specifically, it can be known from the above technical solutions:

Through the wireless connection between the hand controller and the controller, the controller is used to control the driving mechanism, and the driving mechanism drives the movable inner tube to move up and down so as to ascend/descend the tabletop. The user only needs to control the hand controller to adjust the height of the tabletop, instead of the traditional manual adjustment. The adjustment is more convenient and saves time and labour. The structure of the product is simple and stable. The functions are various, meeting the needs of use.

DETAILED DESCRIPTION OF THE PREFERRED EMBODIMENTS

Figure 1:
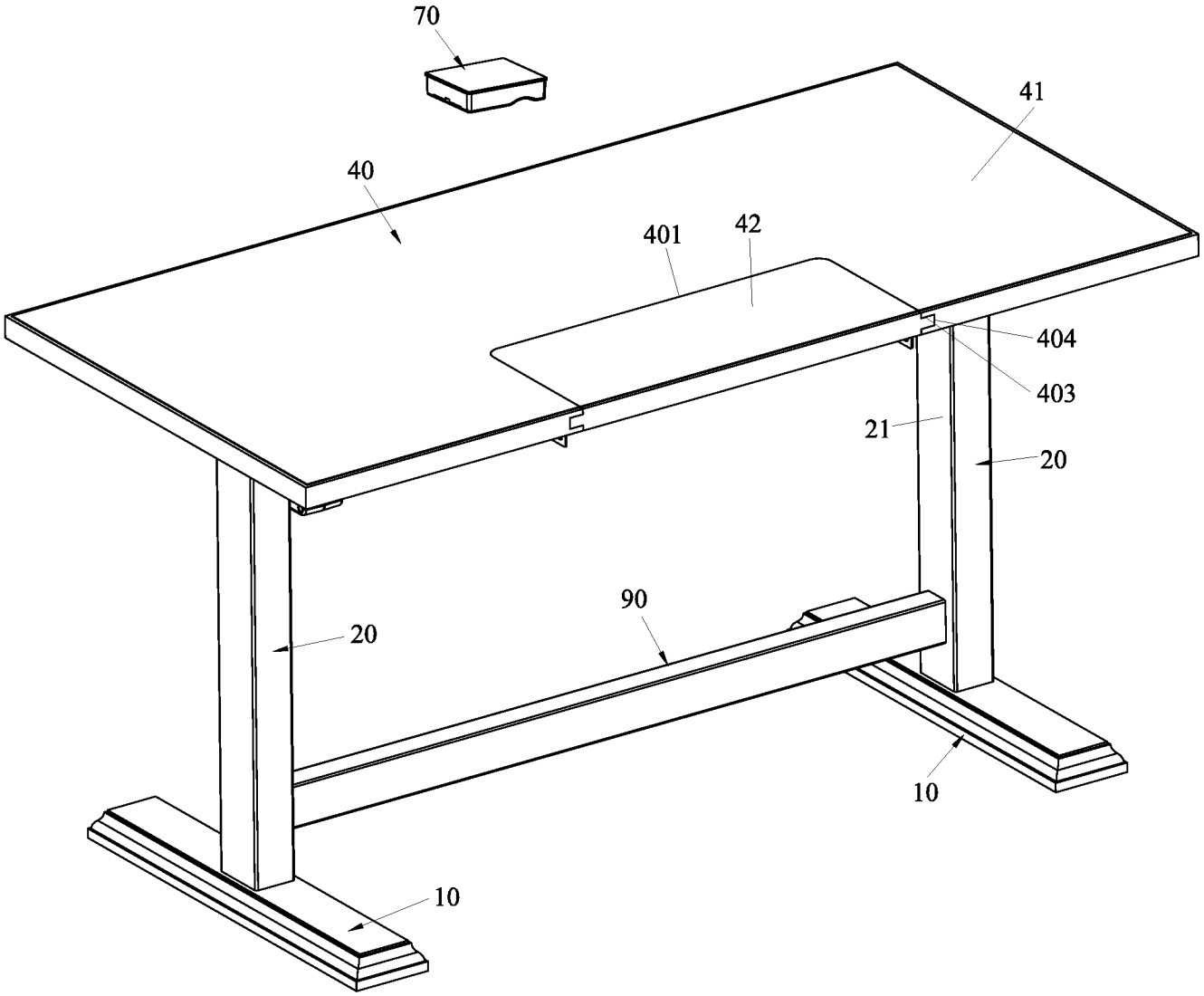
FIG. 1 is a perspective view according to a preferred embodiment of the present invention.
Figure 2:
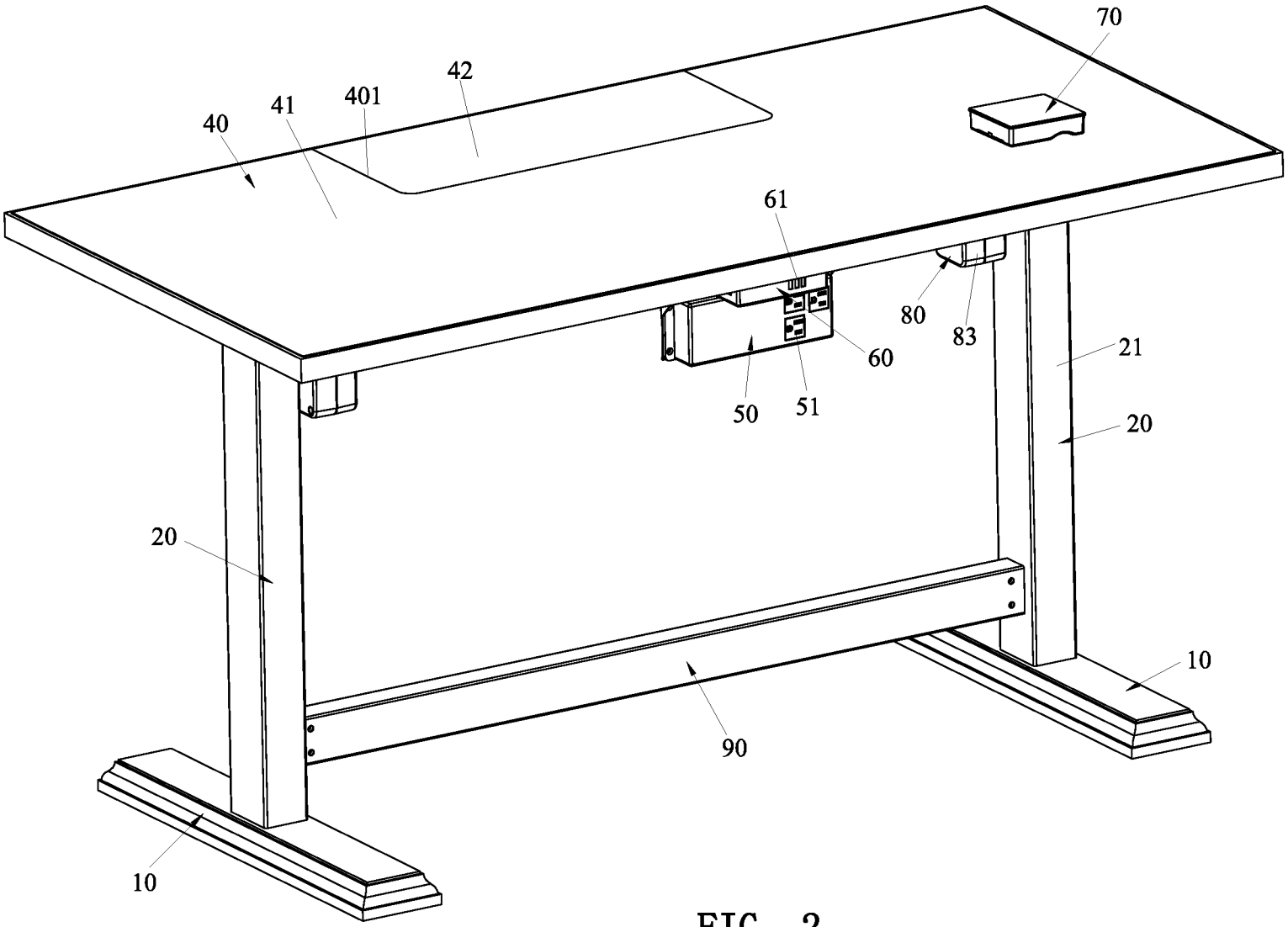
FIG. 2 is another perspective view according to the preferred embodiment of the present invention.
Figure 3:
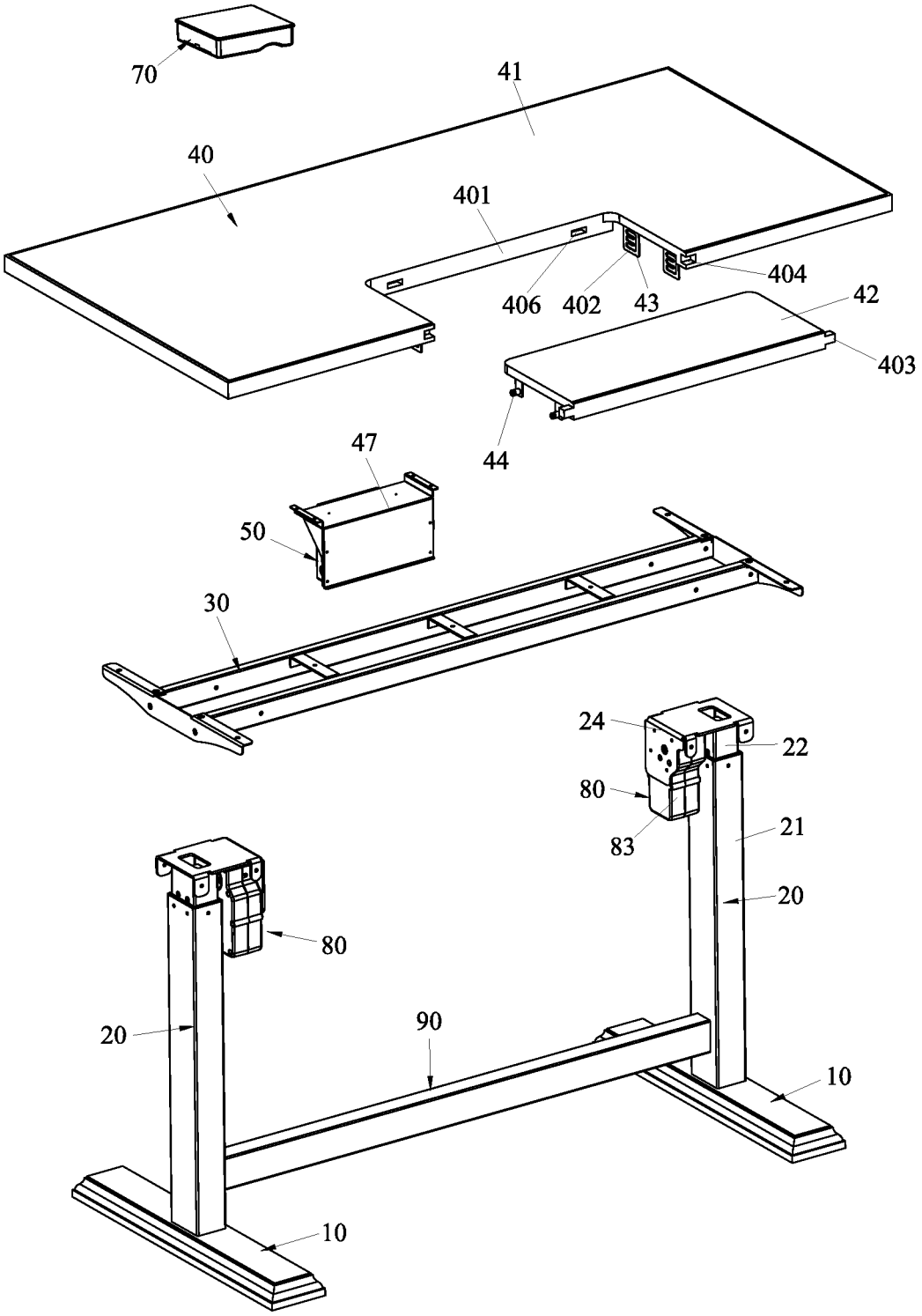
FIG. 3 is an exploded view according to the preferred embodiment of the present invention.
Figure 4:
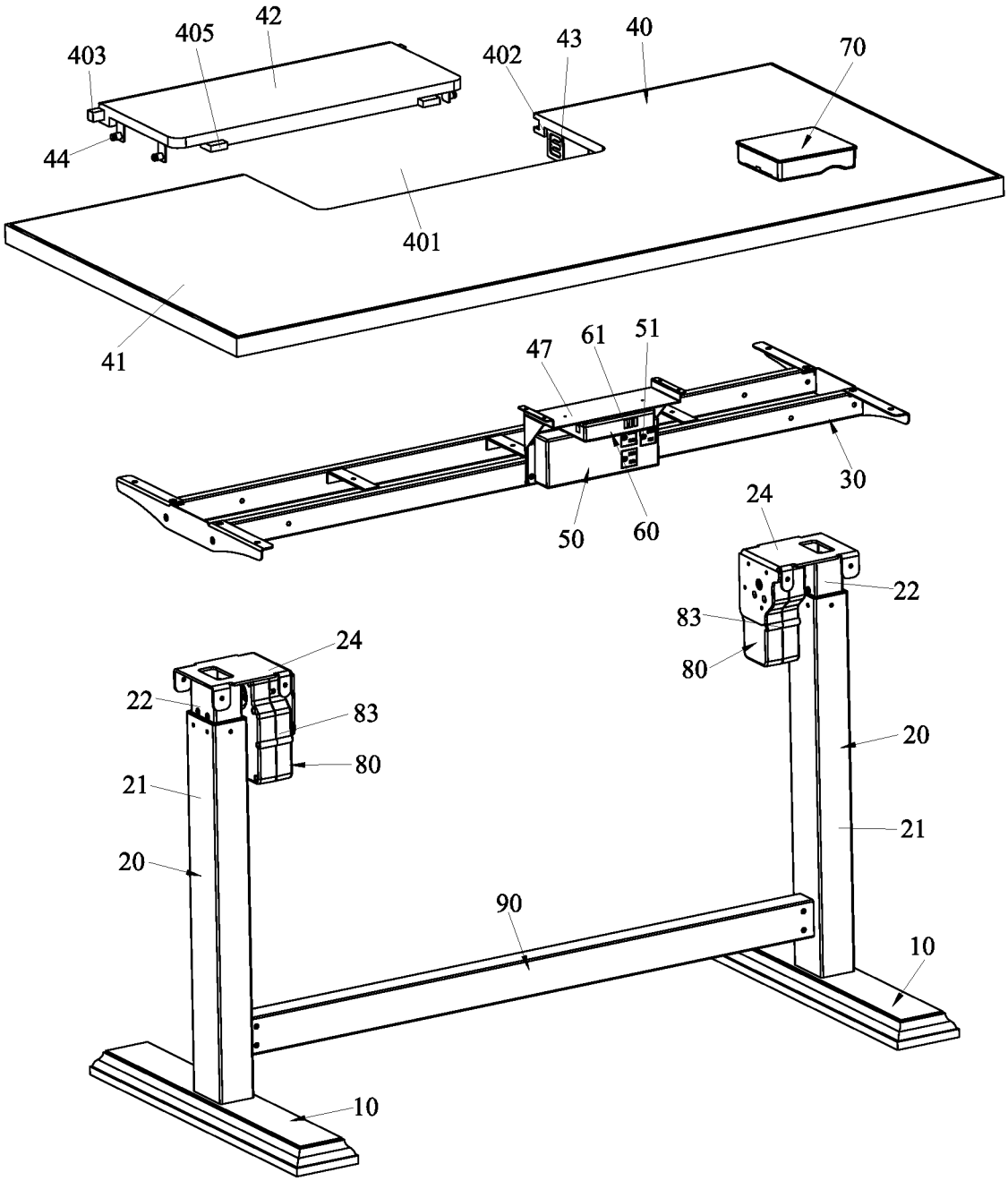
FIG. 4 is another exploded view according to the preferred embodiment of the present invention.

Please refer to FIG. 1 to FIG. 11, a height-adjustable multifunctional table in accordance with a preferred embodiment of the present invention comprises a base 10, at least two independent and height-adjustable table legs 20, a retaining frame 30, a tabletop 40, a power adapter 50, a controller 60, and a hand controller 70.

The table legs 20 are spaced apart and arranged vertically. Each of the table legs 20 includes an immovable outer tube 21 and a movable inner tube 22. A lower end of the immovable outer tube 21 is fixed to the base 10. The movable inner tube 22 can be moved up and down and is disposed in the immovable outer tube 21. An upper end of the movable inner tube 22 extends out of the immovable outer tube 21. Each of the table legs 20 is provided with a driving mechanism 80 for driving the movable inner tube 22 to move up and down. In this embodiment, the base 10 includes a left base and a right base corresponding to the two table legs 20. The two table legs 20 are vertically disposed on the left and right bases 10, respectively. A connecting rod 90 is connected between the immovable outer tubes 21 of the two table legs 20 to enhance the overall structural strength of the table. The driving mechanism 80 includes an immovable screw rod 81, a movable screw sleeve 82, and a motor assembly 83. The immovable screw rod 81 and the movable screw sleeve 82 are disposed in the movable inner tube 22. A lower end of the immovable screw rod 81 is fixedly connected to the lower end of the immovable outer tube 21. The movable screw sleeve 82 is screwedly connected to the immovable screw rod 81. An upper end of the movable screw sleeve 82 is rotatably connected to the upper end of the movable inner tube 22. The motor assembly 83 is mounted to the upper end of the movable inner tube 22 and drives the movable screw sleeve 82 to move back and forth. In this embodiment, the motor assembly 83 drives the movable screw sleeve 82 to rotate through a driving shaft 84. Both the immovable outer tube 21 and the movable inner tube 22 are metal tubes. The inner wall of the upper end of the immovable outer tube 21 and the outer wall of the lower end of the movable inner tube 22 are sleeved with plastic spacers 23. The upper end of the movable inner tube 22 is connected with a fixing plate 24. The motor assembly 83 is fixedly connected to the underside of the fixing plate 24.

The retaining frame 30 is fixedly connected to the upper end of the movable inner tube 22 of each of the table legs 20. The tabletop 40 is disposed on top of the retaining frame 30 and fixedly connected to the retaining frame 30. Specifically, the tabletop 40 includes a tabletop main body 41 and a keyboard bracket 42. A front side of the tabletop main body 41 is formed with an accommodating notch 401. The keyboard bracket 42 is matched with the accommodating notch 401 and is detachably connected to the accommodating notch 401. Left and right sides of the accommodating notch 401 are provided with two adjustment pieces 43, respectively. The two adjustment pieces 43 are spaced apart from each other. Each of the adjustment pieces 43 is formed with a plurality of adjustment grooves 402. Left and right sides of the keyboard bracket 42 are provided with adjustment shafts 44 matched with the adjustment grooves 402. The adjustment shafts 44 are engaged in the corresponding adjustment grooves 402, respectively. A tension spring 45 is connected between a rear side of the keyboard bracket 42 and the tabletop main body 41. Two ends of the tension spring 45 are fixedly connected to the keyboard bracket 42 and the tabletop main body 41 through fixing pieces 46, respectively. Left and right sides of a front end of the keyboard bracket 42 are provided with first protrusions 403 extending laterally. Correspondingly, left and right sides of a front end of the accommodating notch 401 are formed with first recesses 404 matched with the first protrusions 403, respectively. The rear side of the keyboard bracket 42 is provided with a plurality of second protrusions 405 that are spaced apart each other. Correspondingly, a rear side surface of the accommodating notch 401 is formed with second recesses 406 matched with the second protrusions 405.

Figure 9:
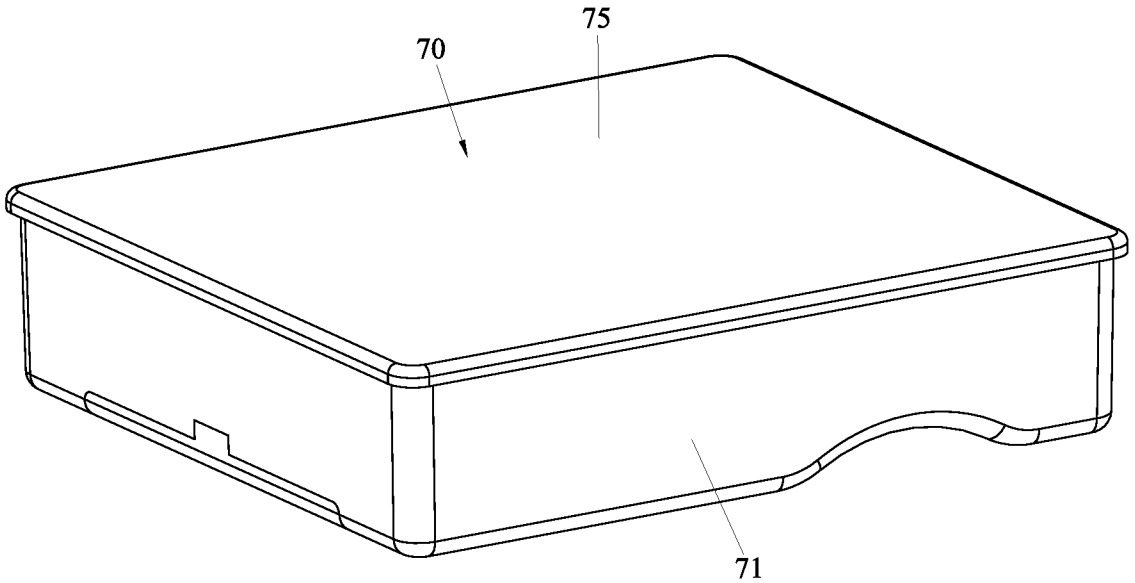
FIG. 9 is an enlarged schematic view of the hand controller according to the preferred embodiment of the present invention.
Figure 10:
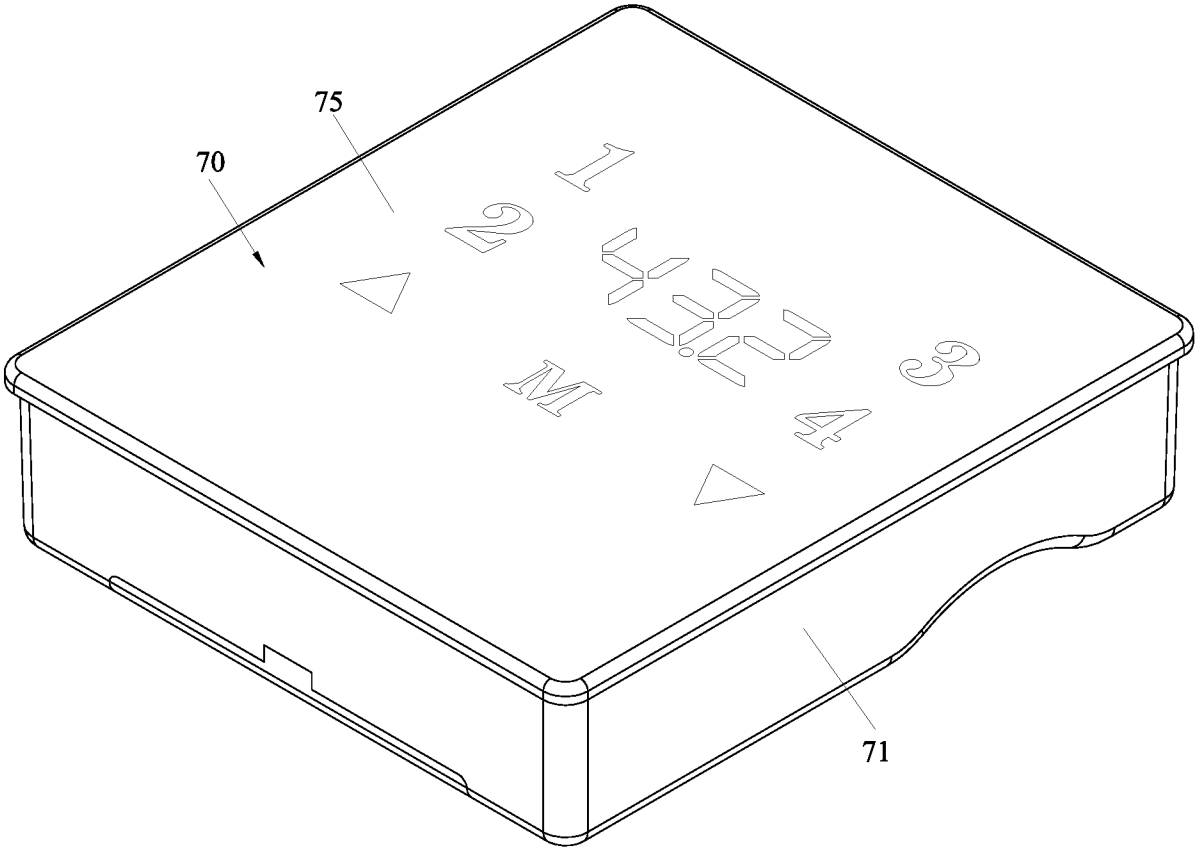
FIG. 10 is a schematic view showing the operation of the hand controller according to the preferred embodiment of the present invention.
Figure 11:
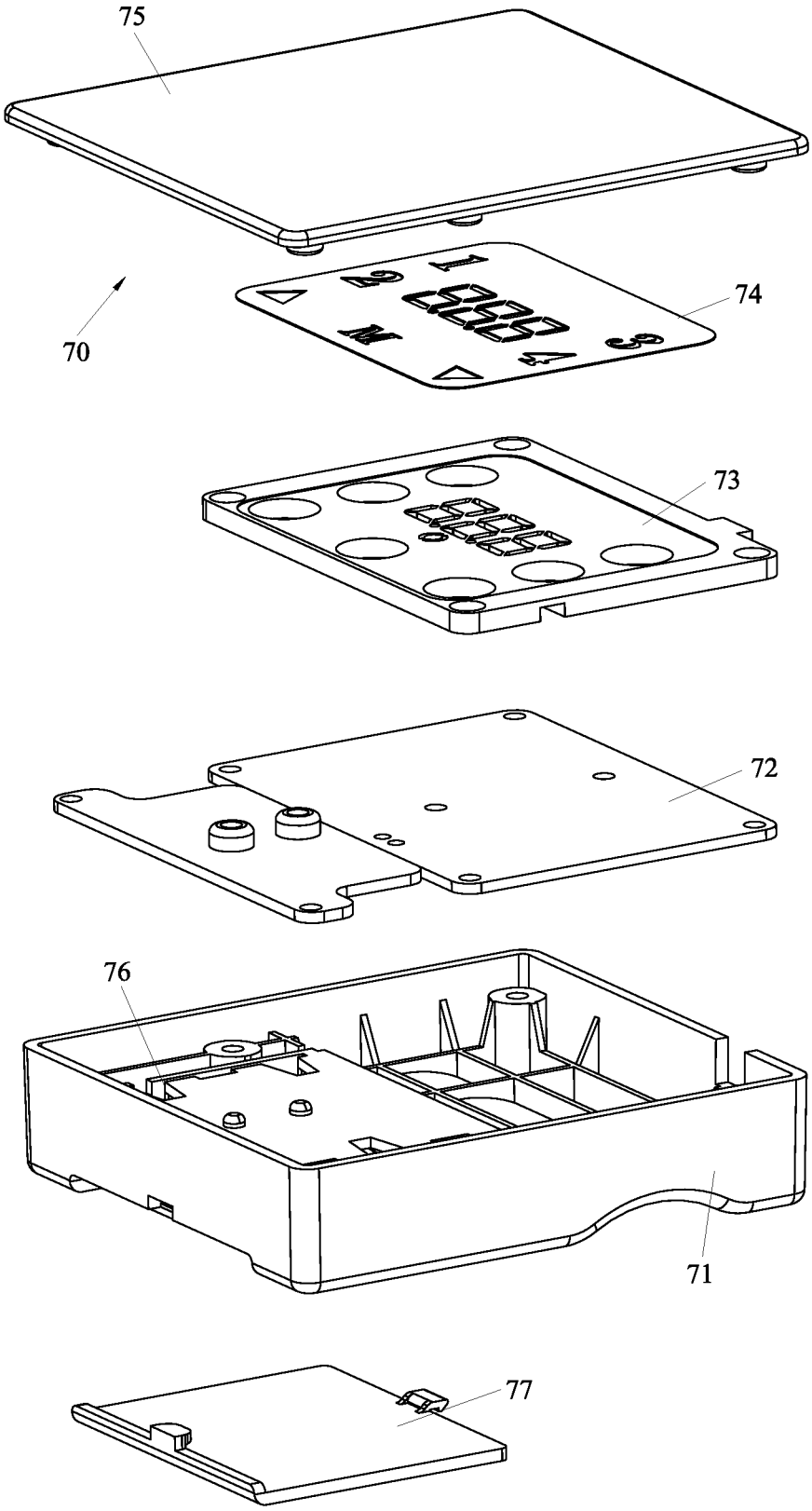
FIG. 11 is an exploded view of the hand controller according to the preferred embodiment of the present invention.

Both the power adapter 50 and the controller 60 are fixedly connected to the tabletop 40. The controller 60 is connected to the power adapter 50. The driving mechanism 80 is connected to the controller 60. The hand controller 70 is wirelessly connected to the controller 60. In this embodiment, the power adapter 50 and the controller 60 are fixed to the underside of the rear side of the tabletop 40 through a mounting plate 47. The power adapter 50 is a power adapter with a power socket 51, which can supply AC power to the electric equipment on the tabletop. The controller 60 has a plurality of USB interfaces 61 for charging, which can supply DC power to a device that needs a USB interface for charging or supplying power. The motor assembly 83 is connected to the controller 60. As shown in FIG. 9 to FIG. 11, the hand controller 70 includes a housing 71, a control board 72, a light-pervious aperture plate 73, a pattern light diffuser film 74, and a touch panel 75. The control board 72 is disposed in the housing 71. The light-pervious aperture plate 73 is stacked on the control board 72. The pattern light diffuser film 74 is stacked on the light-pervious aperture plate 73. The touch panel 75 is stacked on the pattern light diffuser film 74. The housing 71 has an elastic battery clip 76. The bottom of the housing 71 is provided with a battery cover 77. The touch panel 75 is made of a black translucent material. Since the touch panel 75 is made of a black translucent material, the hand controller 70 is completely black when there is no operation. Only when the LED light on the control panel 72 is illuminated on the touch panel 75 during operation, a key function pattern can be seen clearly.

The hand controller 70 is a separate unit that communicates with the controller 60 remotely in a wireless means. The hand controller 70 has a two-way data transmission function with the controller 60. The hand controller 70 is a device that can supply working power in a two-way manner. The hand controller 70 can be powered by a battery or powered by USB. The control board 72 in the hand controller 70 is provided with a protection circuit. When the USB is used to supply power, the battery power will be automatically disconnected to prevent the battery from heating up. The tabletop 40 is formed with a predetermined hole (not shown). When the hand controller 70 is not in use, it can be placed in the predetermined hole in the tabletop 40. The height of the table can be adjusted by the hand controller 70. The hand controller 70 may be operated directly on the surface of the tabletop 40, which is convenient for use.

The use of this embodiment is described as follows:

In use, the power adapter 50 is connected to an AC power source, and the hand controller 70 is installed with a battery or has been charged. When it is necessary to adjust the height of the tabletop 40, the hand controller 70 is manually operated. The hand controller 70 sends a control signal to the controller 60, and the controller 60 controls the driving mechanism 80 to actuate. The motor assembly 83 drives the movable screw sleeve 82 to rotate through the driving shaft 84, so that the movable screw sleeve 82 moves up and down along the immovable screw rod 81. The movable screw sleeve 82 moves up/down to drive the retaining frame 30 and the tabletop 40 to move up/down, thereby adjusting the height of the tabletop 40.

Figure 5:
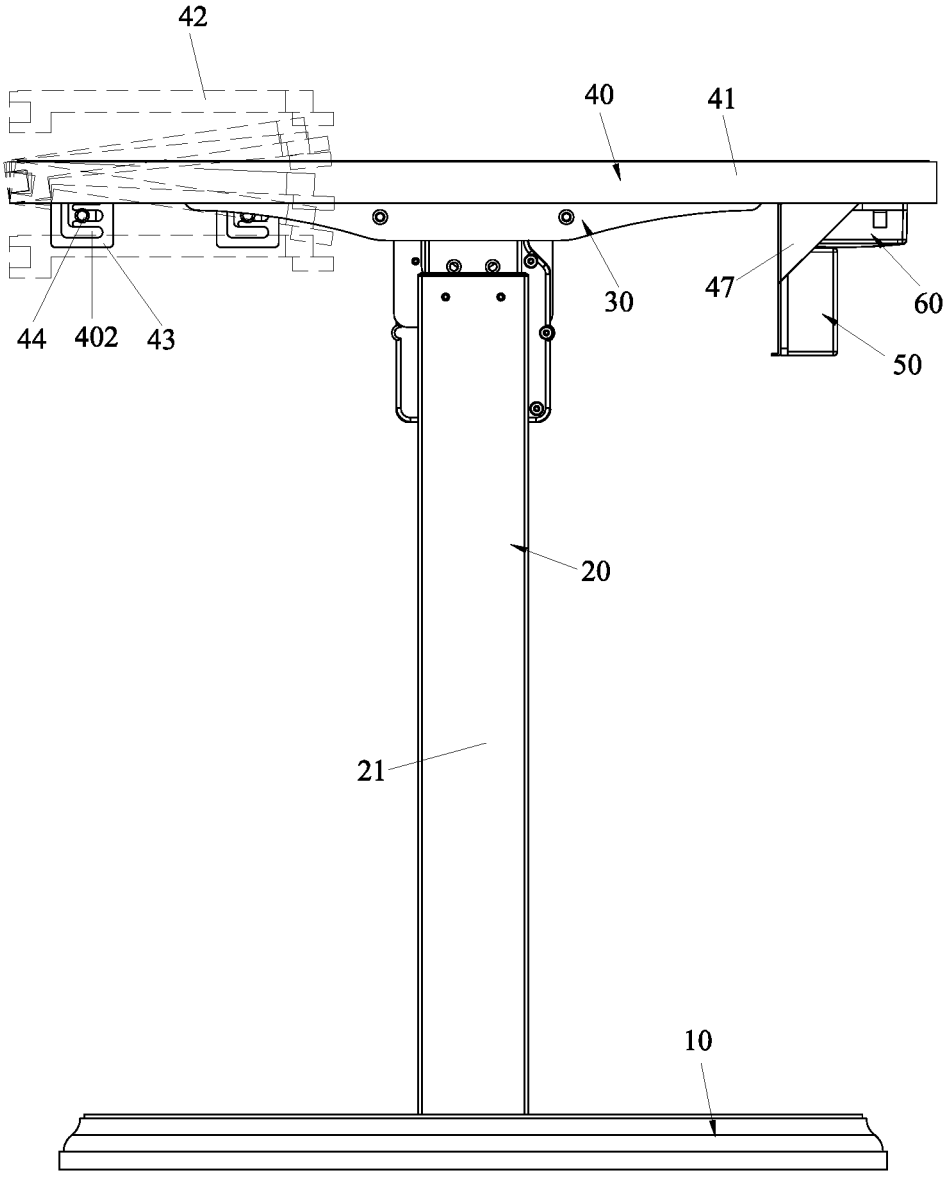
FIG. 5 is a side view according to the preferred embodiment of the present invention.
Figure 6:
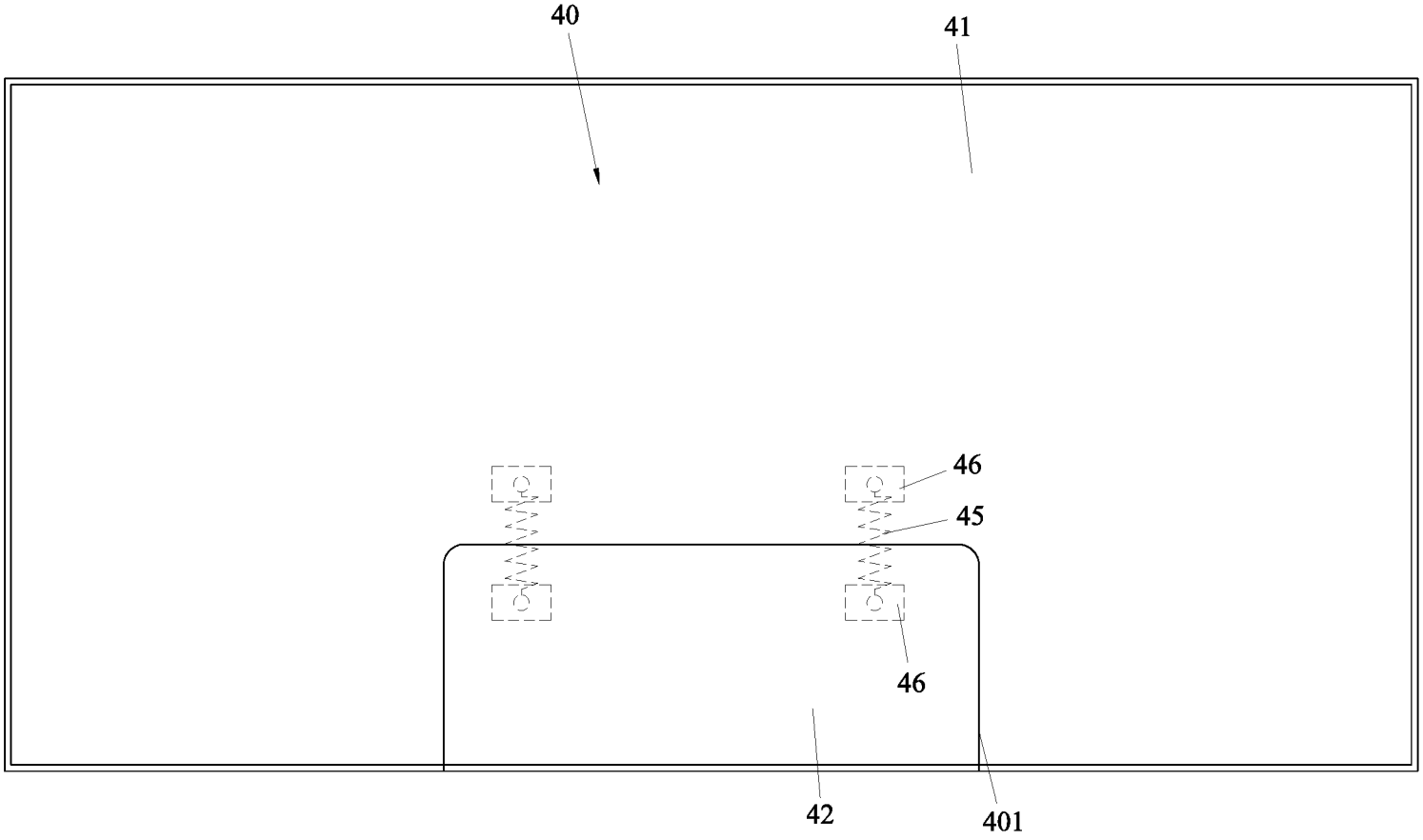
FIG. 6 is a top view of the tabletop according to the preferred embodiment of the present invention.
Figure 7:
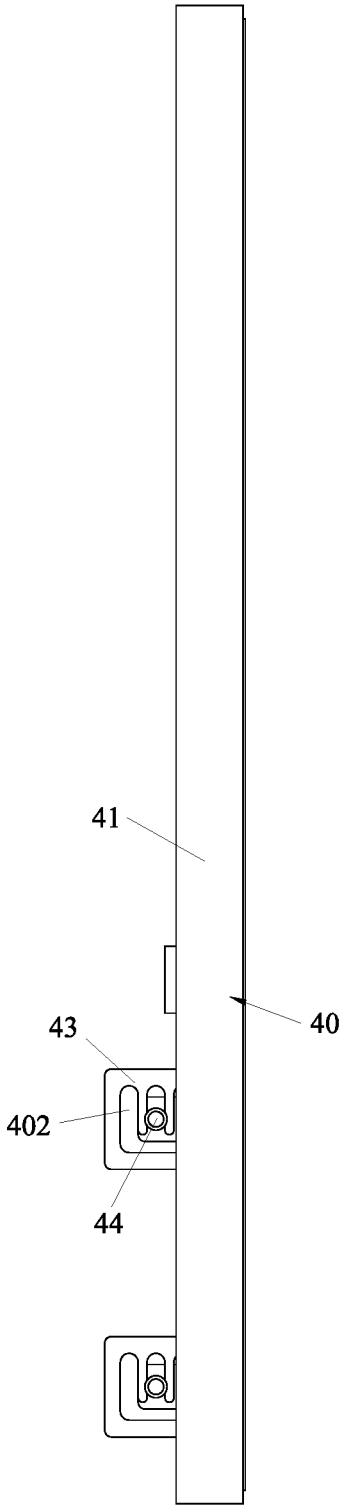
FIG. 7 is a side view of the tabletop according to the preferred embodiment of the present invention.
Figure 8:
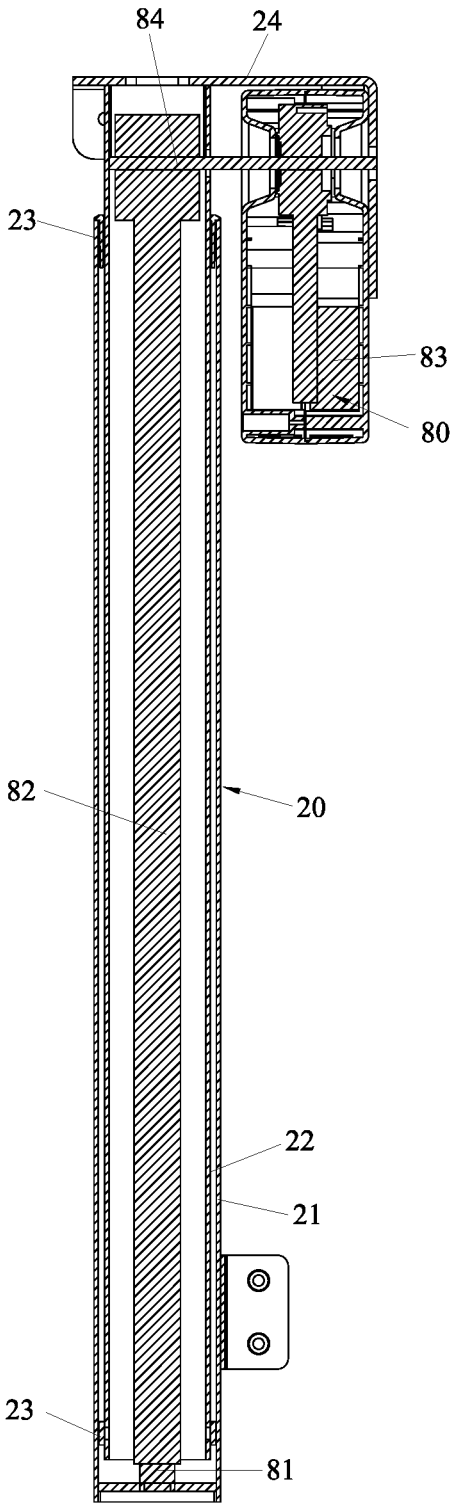
FIG. 8 is a sectional view of the table leg according to the preferred embodiment of the present invention.

As shown in FIG. 5, the keyboard bracket 42 and the tabletop main body 41 are combined to form a flat tabletop through the adjustment shafts 44, the adjustment pieces 43 and a plurality of tension springs 45 disposed between the keyboard bracket 42 and the tabletop main body 41. When the user wants to change the angle of the keyboard bracket 42 according to the needs of use, the keyboard bracket 42 is slightly pulled forward. The adjustment shafts 44 are inserted into the different adjustment grooves 402 of the adjustment pieces 43, so that the orientation of the keyboard bracket 42 can be easily changed to be oblique upwardly or downwardly or above the tabletop or under the tabletop.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A height-adjustable multifunctional table, comprising a base, at least two independent and height-adjustable table legs, a retaining frame, a tabletop, a power adapter, a controller, and a hand controller;

the table legs being spaced apart and arranged vertically, each of the table legs including an immovable outer tube and a movable inner tube, a lower end of the immovable outer tube being fixed to the base, the movable inner tube being movably disposed in the immovable outer tube, an upper end of the movable inner tube extending out of the immovable outer tube; each of the table legs being provided with a driving mechanism for driving the movable inner tube to move up and down;

the retaining frame being fixedly connected to the upper end of the movable inner tube of each of the table legs, the tabletop being disposed on top of the retaining frame and fixedly connected to the retaining frame;

the power adapter and the controller being fixedly connected to the tabletop, the controller being connected to the power adapter, the driving mechanism being connected to the controller; the hand controller being wirelessly connected to the controller;

wherein the hand controller includes a housing, a control board disposed in the housing, a light-pervious aperture plate stacked on the control board, a pattern light diffuser film stacked on the light-pervious aperture plate, and a touch panel stacked on the pattern light diffuser film.

2. The height-adjustable multifunctional table as claimed in claim 1, wherein the base includes a left base and a right base corresponding to the two table legs, the two table legs are vertically disposed on the left and right bases respectively, and a connecting rod is connected between the immovable outer tubes of the two table legs.

3. The height-adjustable multifunctional table as claimed in claim 1, wherein the driving mechanism includes an immovable screw rod, a movable screw sleeve, and a motor assembly; the immovable screw rod and the movable screw sleeve are disposed in the movable inner tube, a lower end of the immovable screw rod is fixedly connected to the lower end of the immovable outer tube; the movable screw sleeve is screwedly connected to the immovable screw rod, an upper end of the movable screw sleeve is rotatably connected to the upper end of the movable inner tube; the motor assembly is mounted to the upper end of the movable inner tube and drives the movable screw sleeve to move back and forth, and the motor assembly is connected to the controller.

4. The height-adjustable multifunctional table as claimed in claim 1, wherein the power adapter includes a power socket.

5. The height-adjustable multifunctional table as claimed in claim 1, wherein the controller has a plurality of USB interfaces for charging.

6. The height-adjustable multifunctional table as claimed in claim 1, wherein the housing has an elastic battery clip, and a bottom of the housing is provided with a battery cover.

7. The height-adjustable multifunctional table as claimed in claim 1, wherein the tabletop includes a tabletop main body and a keyboard bracket; a front side of the tabletop main body is formed with an accommodating notch, and the keyboard bracket is matched with the accommodating notch and detachably connected to the accommodating notch.

8. The height-adjustable multifunctional table as claimed in claim 7, wherein left and right sides of the accommodating notch are provided with two adjustment pieces respectively, the two adjustment pieces are spaced apart from each other, each of the adjustment pieces is formed with a plurality of adjustment grooves, left and right sides of the keyboard bracket are provided with adjustment shafts matched with the adjustment grooves, the adjustment shafts are engaged in the corresponding adjustment grooves, respectively; and a tension spring is connected between a rear side of the keyboard bracket and the tabletop main body.

9. The height-adjustable multifunctional table as claimed in claim 7, wherein left and right sides of a front end of the keyboard bracket are provided with first protrusions extending laterally, left and right sides of a front end of the accommodating notch are formed with first recesses matched with the first protrusions, respectively; the rear side of the keyboard bracket is provided with a plurality of second protrusions that are spaced apart each other, and a rear side surface of the accommodating notch is formed with second recesses matched with the second protrusions.

* * * * *